US007861987B2

(12) United States Patent
Gorsuch et al.

(10) Patent No.: US 7,861,987 B2
(45) Date of Patent: Jan. 4, 2011

(54) HUNTING ACCESSORY HOLDING DEVICES

(75) Inventors: Timothy M. Gorsuch, Mukwonago, WI (US); James A. Buckley, Mequon, WI (US)

(73) Assignee: Timothy M. Horsuch, Mukwonago, WI (US)

( * ) Notice: Subject to any disclaimer, the term of this patent is extended or adjusted under 35 U.S.C. 154(b) by 198 days.

(21) Appl. No.: 12/183,297

(22) Filed: Jul. 31, 2008

(65) Prior Publication Data

US 2010/0102184 A1 Apr. 29, 2010

(51) Int. Cl.
*A47B 96/06* (2006.01)

(52) U.S. Cl. ..... 248/219.1; 248/216.1; 248/219.4; 124/86

(58) Field of Classification Search ..... 182/187, 182/188; 248/218.4, 122.1, 216.1, 219.1, 248/219.4; 124/1, 86
See application file for complete search history.

(56) References Cited

U.S. PATENT DOCUMENTS

| | | | | | |
|---|---|---|---|---|---|
| 584,871 | A | | 6/1897 | Gordon | |
| 3,136,519 | A | | 6/1964 | Spriggle | |
| 3,185,422 | A | | 5/1965 | Spindler | |
| 3,776,498 | A | * | 12/1973 | Peters et al. | 248/219.1 |
| 4,470,106 | A | | 9/1984 | Norton | |
| 4,542,873 | A | | 9/1985 | Matherly et al. | |
| 4,708,221 | A | * | 11/1987 | Kubiak | 182/187 |
| 4,722,501 | A | | 2/1988 | Ruhl | |
| 4,729,363 | A | | 3/1988 | Skyba | |
| 4,744,537 | A | | 5/1988 | Buckley | |
| 5,263,675 | A | * | 11/1993 | Roberts et al. | 248/219.4 |
| 5,310,150 | A | | 5/1994 | Fecko | |
| 5,310,151 | A | | 5/1994 | Engel | |
| 5,482,241 | A | | 1/1996 | Oglesby | |
| 5,484,253 | A | | 1/1996 | Johnson | |
| 5,518,083 | A | * | 5/1996 | Blennert | 182/188 |
| 5,619,981 | A | | 4/1997 | Breedlove | |
| 5,685,103 | A | * | 11/1997 | Wiggins | 42/94 |
| 5,692,716 | A | | 12/1997 | Himmelsbach | |
| 5,727,760 | A | * | 3/1998 | Wytovak et al. | 248/217.3 |
| 5,769,372 | A | * | 6/1998 | Klosterman | 248/219.4 |
| 5,806,508 | A | | 9/1998 | Stempien et al. | |
| 5,857,651 | A | * | 1/1999 | Kunevicius | 248/230.8 |
| 6,059,240 | A | * | 5/2000 | Gorsuch | 248/219.4 |
| 6,478,272 | B1 | * | 11/2002 | McKinsey et al. | 248/216.1 |
| 6,663,065 | B1 | * | 12/2003 | Whittenburg | 248/219.1 |
| 6,948,690 | B1 | * | 9/2005 | Sandel | 248/218.4 |
| 2003/0038218 | A1 | * | 2/2003 | Eppard et al. | 248/219.4 |

(Continued)

*Primary Examiner*—Terrell Mckinnon
*Assistant Examiner*—Bradley H Duckworth
(74) *Attorney, Agent, or Firm*—Boyle Fredrickson, S.C.

(57) ABSTRACT

A device for holding archery bows and/or other hunting accessories is provided. The hunting accessory holding device includes a base member that attaches to a mounting substrate such as a tree, an arm assembly that is configured to hold the archery bow, and a lift mechanism that connects the arm assembly to the base member. The lift mechanism automatically retracts the arm assembly upwardly, from an extended position to a retracted position, when the bow is removed from the arm assembly, thereby removing the arm assembly from the hunter's view and way. The lift mechanism can include a spring that provides a retracting force for moving the arm assembly. As desired, the lift mechanism can also provide an adjustable or variable braking force that opposes the retracting force and enables the hunter to determine a rate of arm retraction, as desired.

20 Claims, 4 Drawing Sheets

U.S. PATENT DOCUMENTS

2006/0231707 A1* 10/2006 Schrot ..... 248/218.4
2009/0078500 A1* 3/2009 Wydner et al. ..... 182/3
2009/0321186 A1* 12/2009 Louchart ..... 182/188

* cited by examiner

HUNTING ACCESSORY HOLDING DEVICES

BACKGROUND OF THE INVENTION

1. Field of the Invention

The invention relates generally to hunting accessories and, more particularly, to devices for temporarily holding bows, photography or video cameras, and/or other hunting accessories when hunting from a tree stand, other hunting stand, or on the ground.

2. Discussion of the Related Art

Archery bow holders and other hunting accessory holders, conventionally referred to as, e.g., bow holders, bow holding devices, holders, holder devices, hangers, hooks, or hunting accessory holding devices, are rather commonplace in various hunting industries. The holders, holding devices, hanger, or hooks, are used to temporarily hold or suspend various hunting-related articles during hunting activities.

Typical bow holders are rigid structures for supporting the weight of a bow or other hunting accessories during extended periods of time while the hunter awaits the presence of game animals. In other words, during use, typical bow holders have fixed components and are fixed in position. With such devices, the bow or other hunting accessories cannot be easily disengaged or removed from the holder without sufficient movement and/or noise to alert the intended prey to the hunter's presence. With such a rigid or fixed device, it is possible and even likely that the hunter will make contact with the holder while aiming his bow thus inadvertently alerting the prey. Furthermore, if a bow or other hunting accessory is successfully removed from the holder without alerting the game animal, the holder can obscure the hunter's line of sight or freedom of movement in aiming at the intended target. Although various attempts have been made to resolve these issues with at least some success, such attempts can produce yet other issues.

For example, devices as shown in applicant's own U.S. Pat. No. 6,059,240 include certain features which automatic move a holding arm out of the hunter's way, once a bow is removed therefrom. In this regard, the holding arm is removed from the line of sight or bow maneuvering space of the hunter. In particular, the holding arm can be moved by way of, e.g., a hydraulic cylinder or a gas spring cylinder.

However, hydraulic cylinders and gas spring cylinders can be relatively expensive which increases the end cost to the consumer. Also, hydraulic cylinders and gas spring cylinders can be relatively heavy and thus add to the overall mass of the device, which can cause the device to be at times cumbersome or heavy which can fatigue the hunter when transporting to or installing in, e.g., a tree. The hydraulic cylinders disclosed in U.S. Pat. No. 6,059,240 span between distal ends and/or medial portions of upright and horizontally extending components of the device, in a triangulated fashion, to function like a third class lever. Due to such triangulated configuration of the hydraulic cylinder and the upright and horizontally extending components, the outer perimeter of the device encloses a much larger area than if the device were devoid of the hydraulic cylinder, whereby the device can be relatively visually conspicuous. During use of hydraulic cylinders, the fluid flowing past the piston or through the valving, or the piston traversing the length of the cylinder, can at times produce a noise or sound, hence potentially "spooking" the animal being hunted. Also, various flow characteristics of fluid within the hydraulic cylinder will change as a function of temperature, whereby during cold operating conditions, it could take relatively more time for the hydraulic cylinder to lift the movable device components out of the hunter's way. It is noted that some game animals have rather acute hearing or seeing abilities, whereby any hydraulic or other noises or sounds, or visually noticeable movement of the device, can be detected by the game animals, alerting them of the presence of the hunter(s).

Accordingly, it would be desirable to provide hunting accessory holding devices which automatically retract out of a hunter's line of sight or bow maneuvering space in a silent manner. It would further be desirable to provide such hunting accessory holding devices which have relatively fewer large or elongate components associated with the lifting or retracting mechanism(s), are relatively lightweight, easy to install, inexpensive, visually inconspicuous, and are unaffected by temperature and/or other dynamically changing climate or environment related influences. In addition, it would be desirable to provide hunting accessory holding devices with retracting arms that facilitate easy adjustment of a retraction preload setting or the rate of retraction of the retracting arms.

SUMMARY OF THE INVENTION

The present invention is directed to a device for holding archery bows and/or other hunting accessories. The hunting accessory holding device includes a base member that attaches to a mounting substrate such as a tree, an arm assembly that is configured to hold the archery bow, and a lift mechanism that connects the arm assembly to the base member. The lift mechanism automatically retracts the arm assembly upwardly, from a loaded position to an unloaded position, i.e. an extended position to a retracted position. Accordingly, when the bow is removed from the arm assembly, the arm assembly moves or retracts from the hunter's view and way. The lift mechanism can include a spring that provides a retracting force for moving the arm assembly. As desired, the lift mechanism can also provide an adjustable or variable braking force that opposes the retracting force and enables the hunter to determine a rate of arm retraction, as desired. Preferably, the hunting accessory holding device is strong, durable, and lightweight, e.g., weighing about five pounds or less, and easily collapsible and transportable.

In yet other implementations, the base member includes a threaded member that interfaces with the mounting substrate. The threaded member can push against, optionally thread or screw into the mounting substrate.

In some implementations, the lift mechanism is pivotally attached to the base member, enabling the arm assembly to pivot with respect to the base member. The arm assembly can further laterally, horizontally, or otherwise, articulate by way of hinges or articulatable joints provided between adjacent arm segments.

In some implementations, a camera arm assembly is provided for supporting a still or video camera. The camera arm assembly can be used with the bow arm assembly or as a stand alone item also.

A method of using a hunting accessory holding device is disclosed. The method includes providing a hunting accessory holding device that has a base member attaching the device to a mounting substrate, an arm assembly extending outwardly from the base member, and a lift mechanism attaching the arm assembly to the base member. Then, an archery bow is suspended or hung from the arm assembly. When the bow is subsequently removed therefrom, the arm assembly automatically and substantially silently retracts from an extended position to a retracted position.

Other features and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference characters represent like parts throughout.

DETAILED DESCRIPTION OF THE PREFERRED EMBODIMENTS

Figure 1:
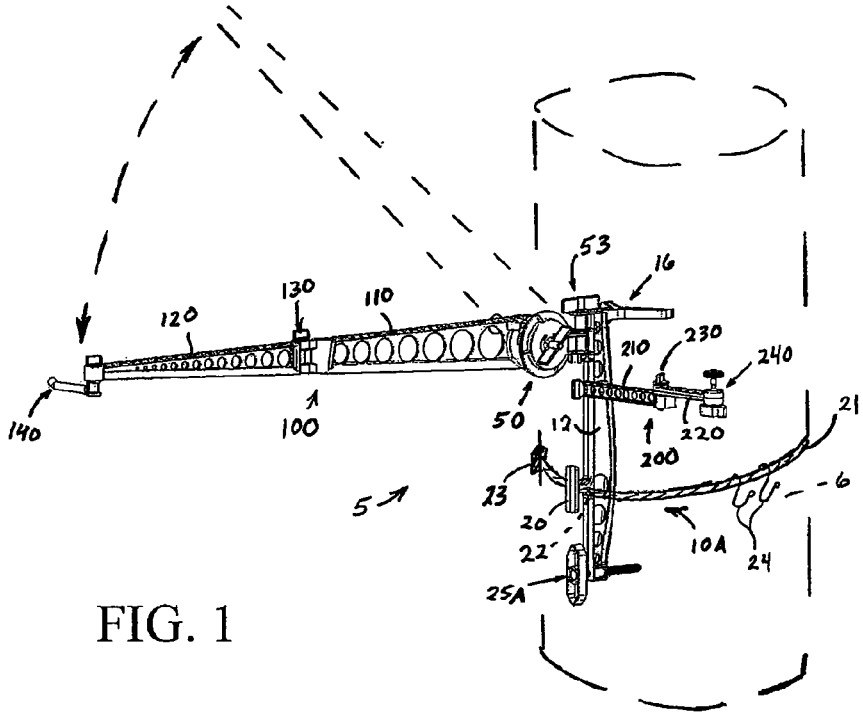
FIG. 1 is a perspective view of a hunting accessory holding device according to a first embodiment of the present invention, strapped to a mounting substrate.

Preferred exemplary embodiments of the bow hunting accessory device of the present invention are illustrated in the accompanying drawings in which like reference numerals represent like parts throughout.

Figure 2:
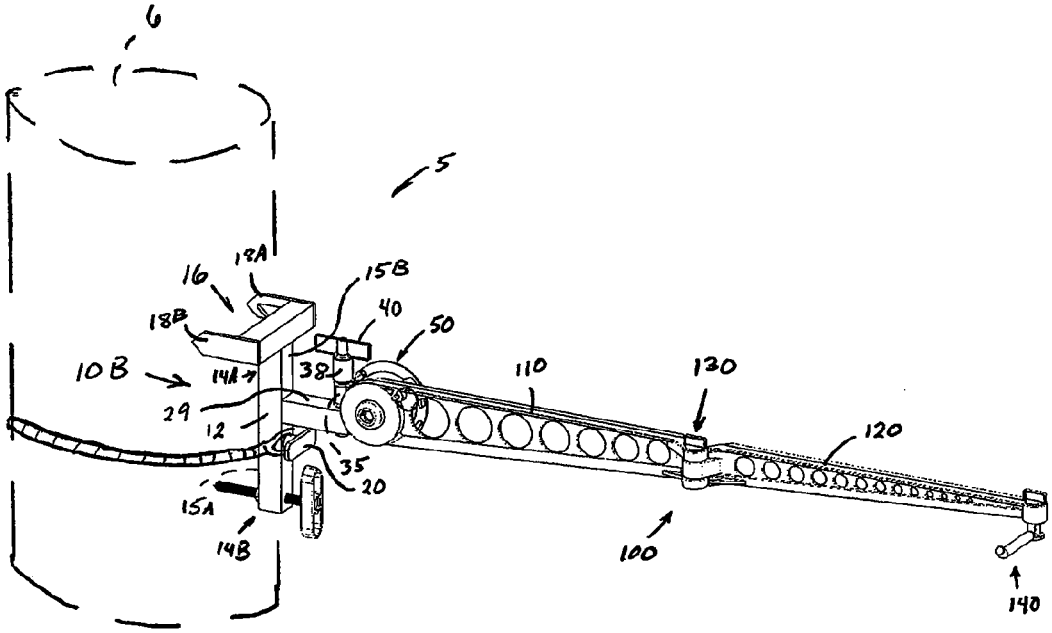
FIG. 2 is a perspective view of a hunting accessory holding device according to a second embodiment of the present invention, strapped to a mounting substrate.
Figure 3:
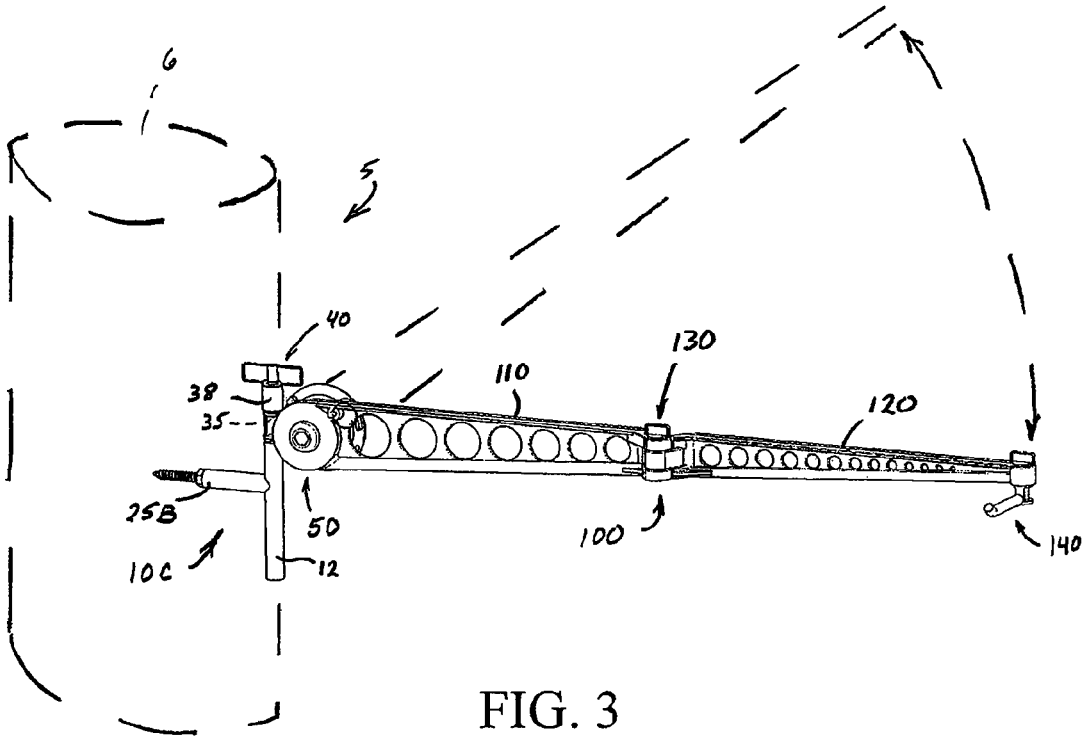
FIG. 3 is a perspective view of a hunting accessory holding device according to a fourth embodiment of the present invention, screwed into a mounting substrate.

FIGS. 1-3 show hunting accessory holding devices 5 of the present invention. Hunting accessory holding devices 5 are configured for use with an accompanying mounting substrate 6 which can be for example, a tree trunk or limb, a pole, and/or other upright support structure. Each hunting accessory holding device 5 is configured to temporarily hold an archery bow and/or other hunting accessory such as still cameras, video cameras, backpacks, deer grunt devices, rattling antlers, or others, as desired, while providing trouble-free access to the bow while mitigating any visual or physical obstruction to the user during hunting activities. In some implementations, the hunting accessory holding device 5 attaches to a tree or other mounting substrate 6 using hardware that penetrates into the mounting substrate 6 (FIG. 3), whilst in other embodiments it attaches without using such penetrating hardware (FIGS. 1,2, 4,9).

Figure 8:
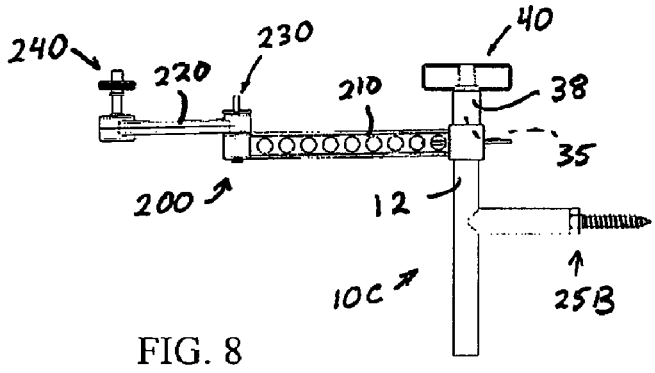
FIG. 8 is a perspective view of another variant of the hunting accessory holding device shown in FIG. 3.
Figure 9:
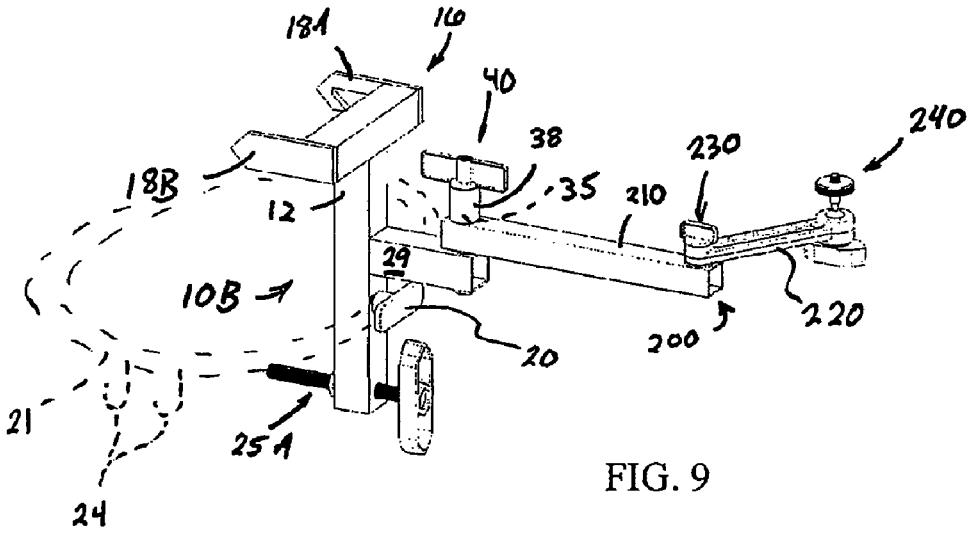
FIG. 9 is a perspective view of a variant of the hunting accessory holding device shown in FIG. 2.

Still referring to FIGS. 1-3, mitigating visual or physical obstruction(s) during hunting activities is accomplished by way of, for example, various automatically and silently retracting features of the hunting accessory holding devices 5. Namely, each hunting accessory holding device 5 can include a base member 10A, 10B, 10C a lift mechanism 50, a bow arm assembly 100, and/or components such as a camera arm assembly 200 (FIGS. 1, 8, and 9).

The bow arm assembly 100 is configured to achieve an extended potion while holding an archery bow, e.g., the position seen in FIGS. 1 and 3, so that it can be easily grasped by a hunter as desired. As is explained in greater detail elsewhere herein, when the hunter removes the bow from the bow arm assembly 100, bow arm assembly 100 automatically withdraws or retracts out of the hunter's line of sight and requisite bow maneuvering area. Stated another way, the lift mechanism 50 connects the bow arm assembly 100 to the respective base member 10A, 10B, whereby the lift mechanism 50 automatically withdraws or retracts at least a portion of the bow arm assembly 100, enhancing the visual field and zone of maneuverability of the user. This retraction or withdrawal is represented by position of bow arm assembly 100 seen in dashed outline in FIGS. 1 and 3.

Figure 4:
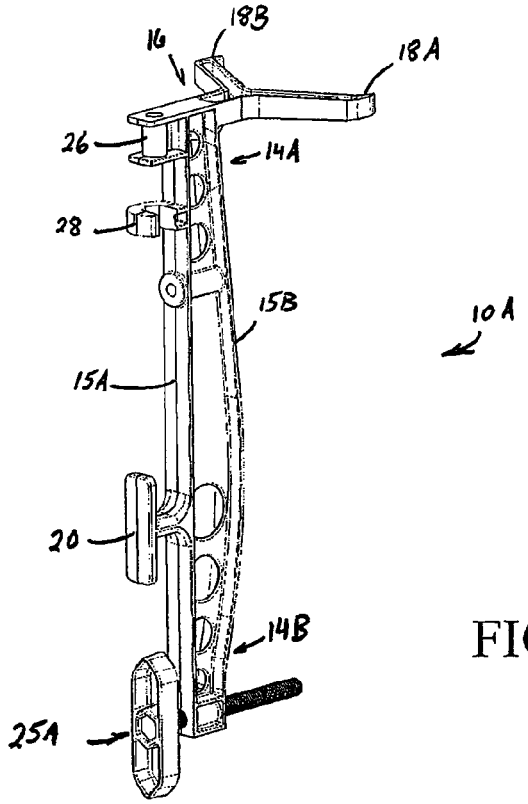
FIG. 4 is a close-up perspective view of the base member shown in FIG. 1.

Referring now to FIGS. 1, 2, and 4, base members 10A and 10B are largely analogous to each other and both serve to support e.g., lift mechanism 50 and/or other components of hunting accessory holding device 5. However, in some implementations, base member 10B can be relatively smaller, lighter, and more compact, enhancing its portability. Each of base members 10A and 10B includes an elongate body 12 that is positioned upright, parallel to and adjacent the tree or other mounting substrate 6. Body 12 includes an upper end 14A, a lower end 14B, and inwardly and outwardly facing surfaces 15A, 15B. A forked member 16 extends from the inwardly facing surface of body 12, generally perpendicularly thereto, and toward the mounting substrate 6. The ends of forked member 16 include first and second barbs or points 18A, 18B, respectively, which are configured to frictionally interface or grip the outer surface of the mounting substrate 6. In some implementations, the forked member 16 has other suitable configurations such as, e.g., more or fewer than two distinct points, an elongate bar, tube, or other configurations suitable for interfacing the intended tree or other mounting substrate 6.

Still referring to FIGS. 1, 2, and 4, a support bracket 20 extends from the outwardly facing surface of body 12 and thus away from the mounting substrate 6. Support bracket 20 is positioned between the first and second ends 14A, 14B, of body 12, optionally at one of the first and second ends 14A, 14B, depending on the particular desired configuration. Preferably, support bracket 20 has a T-shaped profile, whereby it has a first portion that extends parallel to the body 12 and a second portion that extends perpendicularly between and joins the first portion with the body 12. Support bracket 20 can extend longitudinally with respect to body 12 (FIGS. 1 and 4), or transversely with respect to body 12 (FIG. 2). Regardless, the support bracket 20 is configured to cooperate with a strap 21 that secures the base member 10A or 10B to the mounting substrate 6.

Referring now to FIGS. 1 and 2, strap 21 is any of a variety of suitable, flexible, elongate webs, ropes, or cables that can be drawn, tied, or otherwise tightly secured to the mounting substrate 6. Strap 21 can include openings or loops 22 at its ends which slide over and hook onto the support bracket 20 from different opposing directions, when the strap extends around the mounting substrate 6. As desired, hooks or other suitable hanging hardware can be attached to the strap 21 for hanging or otherwise holding, for example, backpacks, deer grunt devices, rattling antlers, and/or other hunting accessories.

Still referring to FIGS. 1 and 2, preferably the strap 21 includes an integrated tightening device 23, such as a ratchet lock mechanism or cam lock mechanism, along its length, enabling the user to easily and securely attach the base member 10A or 10B to the mounting substrate 6 without requiring tools. In other words, when the strap 21 is tightened around the mounting substrate 6, it provides a clamping force as it squeezes against the body 12, holding it in place. As desired, the clamping force provided by strap 21 can be enhanced by using, for example, a threaded member that interfaces with the mounting substrate and cooperates with the strap 21.

Referring again to FIGS. 1, 2, and 4, the lower end 14B of body 12 can include a threaded throughbore that receives a threaded lag bolt 25A. An end of threaded lag bolt 25A that is further from the mounting substrate can have a bolt head or other tool receiving structure, or more preferably, a thumbscrew, thumbnut, knob, or other tool-less interface enabling the user to axially advance or regress the threaded lag bolt 25A through the throughbore. The other end of threaded lag bolt 25A can be pointed so as to penetrate the surface of the mounting substrate 6. For embodiments in which the threaded lag bolt does not penetrate the surface of the mounting substrate 6, the other end of threaded lag bolt 25A is blunt, or includes a flange or planar foot, whereby the blunt, flanged, or footed end merely pushes against the outer surface of the mounting substrate 6 without breaking through. Such implementations can prove particularly useful for providing a force in opposition to the squeezing or clamping force of strap 21, which increases the tautness of strap 21 and thus increases how tightly the base member 10A or 10B is held against the mounting substrate 6.

Still referring to FIGS. 1, 2, and 4, in some implementations, the inwardly facing surface 15A of body 12 is radially or laterally displaced from the outer surface of the tree or other mounting substrate 6. Accordingly, the hunting accessory holding device 5 is attached to the mounting substrate 6 by way of three distinct points of contact, namely the two points 18A, 18B, at the ends of forked member 16 and the end of threaded lag bolt 25A that pushes against the mounting substrate, at least when such three distinct points of contact are utilized cooperatively with strap 21.

Referring now to FIG. 4, base member 10 A can include a first lobe 26 and a second lobe 28 extend perpendicularly from the outwardly facing surface 15B of body 12, adjacent upper end 14A. First lobe 26 is a generally cylindrical structure with an axial throughbore. Second lobe 28 is longitudinally aligned with first lobe 26 and adapted and configured to receive and hold hardware, for example, to capture or hold a bolt head or a nut. First and second lobes 26, 28 are longitudinally spaced from each other, and they are configured to accept and hold a portion of the lift mechanism 50 therebetween.

Referring now to FIG. 2, in lieu of the lobes 26 and 28 of base member 10A (FIGS. 1 and 4), base member 10B has a projection 29 for holding the lift mechanism 50, camera arm assembly 200, or other component. Projection 29 can extend perpendicularly from the outwardly facing surface 15B. Projection 29 defines a shoulder 30 on an upper surface near an outer end thereof. A post 35 extends upwardly from the shoulder 30, serving as mounting structure for holding the lift mechanism 50, camera arm assembly 200, or other component. For example, the hinge barrel 52 of lift mechanism 50 can insert over the post 35, such that the shoulder 30 supports the lower surface of the hinge barrel 52, and thus the entire weight of lift mechanism 50. A collar 38 can also insert over the post 35, above the hinge barrel 52. A nut, thumbnut, or knob 40 is secured to the post 35, preferably above the collar 38. This secures the lift mechanism 50 to the base member 10B while permitting it to pivot thereon. As with the versions incorporating base member 10A of FIG. 1 or 4, when lift mechanism 50 is used with base member 10B, it preferably can pivot through a range of motion of at least about 270 degrees of travel.

Figure 5:
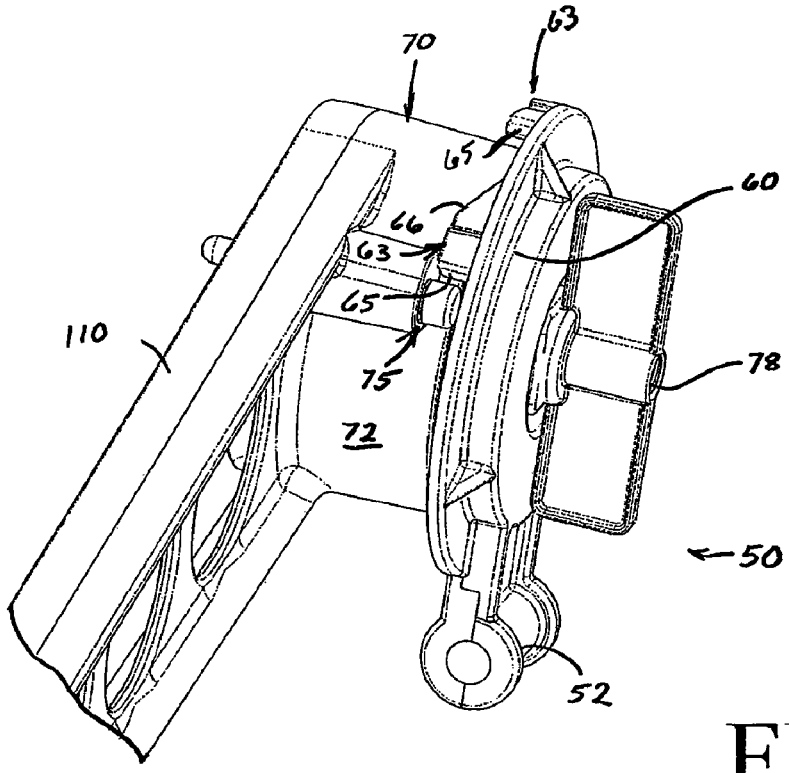
FIG. 5 is a close-up perspective view of the lift mechanism shown in FIGS. 1, 2, and 3.
Figure 6:
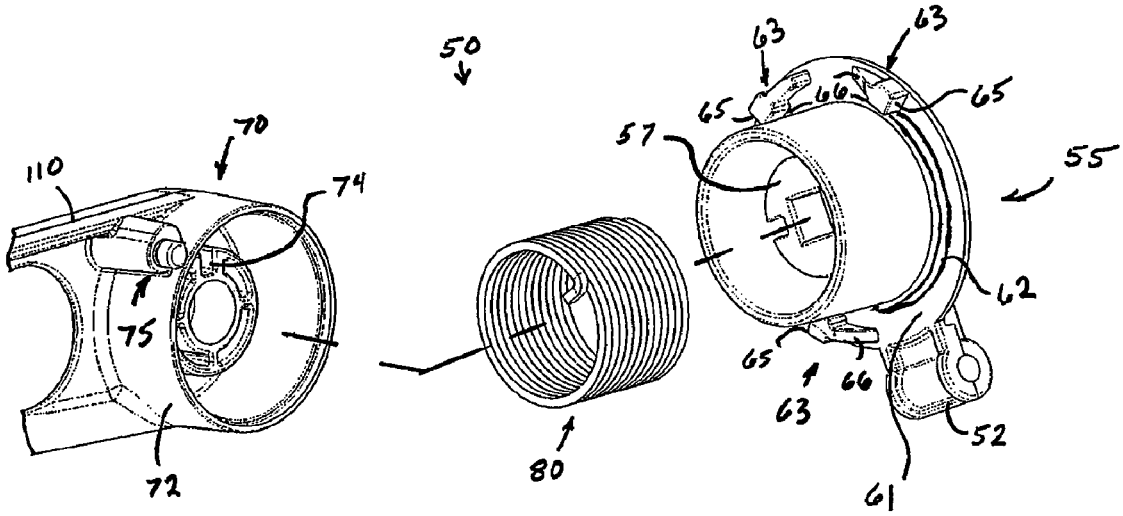
FIG. 6 is a perspective, exploded, view of the lift mechanism shown in FIG. 5.
Figure 7:
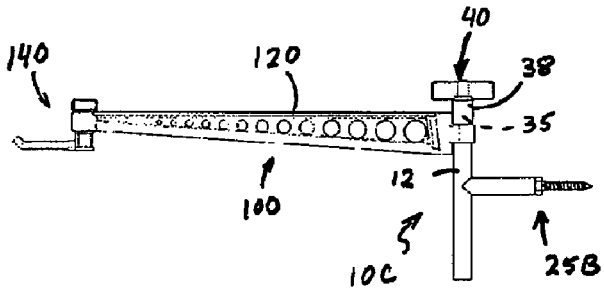
FIG. 7 is a perspective view of a variant of the hunting accessory holding device shown in FIG. 3.

Referring now to FIGS. 4-6, lift mechanism 50 serves as an articulating joint that connects an end of bow arm assembly 100 to a corresponding end of the base member 10A, for example upper end 14A. Optionally, lift mechanism 50 can connect the bow arm assembly 100 to other components of hunting accessory holding device 5, based on the particular intended configuration. Lift mechanism 50 includes a hinge barrel 52 for attaching the lift mechanism 50 to the base member 10A, a canister 55, a cover 70, and a helical torsion spring 80.

Referring still to FIGS. 4-6, hinge barrel 52 is generally cylindrical and is mounted longitudinally between the first and second lobes 26, 28 of body 12. A throughbore extends axially though the hinge barrel 52 and is aligned or registered with the bores or openings that extend through the first and second lobes 26, 28. In the complete assemblage, a pin or bolt 53 extends through all of the bores of the first and second lobes 26, 28, and hinge barrel 52, whereby they, in combination, define a hinged attachment between the base member 10A and lift mechanism 50. In this configuration, the bolt 53 defines a generally upright pivot axis which the lift mechanism 50 pivots about, whereby the lift mechanism 50 pivots laterally with respect the base member 10A. Preferably, the lift mechanism 50 can pivot about bolt 53 through a range of motion of at least about 270 degrees.

Referring now to FIGS. 5 and 6, the hinge barrel 52 is attached to the canister 55, which is a partial enclosure that houses the spring 80. A first retaining mechanism 57, provided within the canister 55, receives a first end of the spring 80. The canister 55 has a circumferential sidewall 58 that extends outwardly from a generally circular base plate 60. The base plate 60 has a larger diameter than the canister sidewall 58, so that the outer perimeter of the base plate 60 defines an annular ledge extending beyond the canister sidewall 58. Such annular ledge defines an arm facing surface 61. A thrust bearing 62 (FIG. 5), polymeric or otherwise, can be snugly installed concentrically around the canister sidewall 58, so that it seats against the arm facing surface 61.

Still referring to FIGS. 5 and 6, one or more projections 63 extend axially from the arm facing surface 61 of the base plate 60. For embodiments including multiple projections 63 which are spaced circumferentially, the projections 63 can serve at least a partial locating function to help retain the cover 70 in proper concentric alignment and registration with respect to the canister 55. Furthermore, the projections 63 can serve as mechanical stops that limit or set travel boundaries for, e.g., the rotation of the arm assembly 100 with respect to base member 10A. At least one of the projections 63 has a pair of sides which extend perpendicularly from the arm facing surface 61, namely sides 65. At least one of the projections 63 includes both a perpendicularly extending side 65 and an angularly extending side, e.g., a ramped surface or ramp 66.

Cover 70 is fixedly attached to, preferably integral with, the bow arm assembly 100. Cover 70 has a circumferential sidewall 72 that extends from a generally circular base plate 71. Cover sidewall 72 also has an inner diameter that is greater in magnitude that the outer diameter of canister sidewall 58. This enables the cover sidewall 72 to overly and concentrically surround the container sidewall 58. In the complete assemblage, an annular clearance is defined between the cover and canister sidewalls 72, 58, enabling the two components to freely rotate with respect to each other. As desired, a high viscosity grease-type or other lubricant can be applied into the clearance between the cover and canister sidewalls 72, 58, ensuring free and silent damped rotation therebetween. This promotes silent articulation in a variety of environments, climates, and temperatures, for example, a range of temperatures between −35 degrees F. and 95 degrees F.

Referring still to FIGS. 5 and 6, a second retaining mechanism 74 is provided within the cover 70 which cooperates with a second end of the spring 80. Cover 70 also includes a retractable pin 75 adjacent the outside of the cover sidewall 72. Preferably, the pin 75 is spring biased in an outwardly extended position. In other words, pin 75 can move axially but, absent forces that overcome the biasing force, it tends to remain in the outwardly extended position.

Referring now to FIGS. 1-3, 5, and 6, as desired, a spring preload condition can be established in the lift mechanism 50 by, for example, turning the cover 70 upon canister 55 and mechanically holding it in position by way of the interfacing relationship between pin 75 and one of the projections 63, thus preserving or storing energy within the spring 80. Thus, rotation of cover 70 upon canister 55 and the position in which pin 75 fixes the cover 70 can influence a retraction force or rate of retraction of the lift mechanism, while it lifts or retracts the bow arm assembly 100.

Referring now to FIGS. 5 and 6, pin 75 will encounter either a side 65 or a ramp 66 of projections 63 when the cover 70 rotates about its axis. As cover 70 rotates, sides 65 act as mechanical stops or interferences that prevent the pin 75 from passing beyond. In other words, when the pin 75 contacts the side 65, extending perpendicularly from the base plate 60, the cover 70 stops rotating. Conversely, when a user rotates the cover 70 and the pin 75 encounters a ramp 66, the ramp 66 merely axially deflects and passes under the pin 75, instead of stopping its traverse as the cover 70 continues to rotate. This action facilitates spring preloading of the positioning of arm 100 in the ready to use position.

Still referring to FIGS. 5 and 6 the pin 75 slides up the ramp 66 and axially regresses, enabling the cover 70 to continue its rotation. As the pin 75 passes beyond the opposite side of ramp 66, the pin 75 is driven forward again by the spring or other resilient member, to the outwardly extending position. The pin 75 can traverse the projection 63 in a first direction, namely over and across the ramp 66, without the user manually retracting the pin 75. However, for the pin 75 to traverse the projection in a second opposite direction, namely over and across side 65, a user must manually retract the pin 75 to provide the needed clearance between the pin 75 and the projection 63. Pulling the pin and allowing movement past the flat side of 65 allows intentional collapse of the device for storage and transport.

Besides being influenced by the retraction force defined by spring 80 and the damping resistance of the grease, the particular rate of arm retraction is influenced, in some implementations, by a braking force that can be established by the lift mechanism. Such braking force acts generally in opposition to the retracting force of spring 80 and, therefore, serves to slow or diminish the rate of arm retraction, thus providing non accelerating retracting motion.

Still referring to FIGS. 5 and 6 a suitable method of establishing and controlling a braking force can be accomplished by way of the canister 55 and cover 70, and the frictional interfacing relationship therebetween. Namely, the canister 55 and cover 70 can be held together by a bolt and thumb nut 78 that extends axially through the center of both of them. Accordingly, by tightening or loosening the thumb nut 78, the canister 55 and cover 70 is held relatively more firmly or loosely against each other. Stated another way, tightening thumb nut 78 squeezes or clamps the canister 55 and cover 70 together, applying a greater compression force on the polymer bearing thus making it relatively more difficult for the cover 70 to rotate, while loosening the bolt relaxes the assemblage making it relatively easier for the cover 70 to rotate. Furthermore, if the user desires the bow arm assembly 100 to remain extended after the bow is removed therefrom, bolt 78 can be tightened to an extent that imposes a large enough braking force upon lift mechanism 50 to prevent the bow arm assembly 100 from retracting.

Referring still to FIGS. 5 and 6, it is further noted that the interfacing relationship between the canister 55 and cover 70 is primarily established between the thrust bearing 62 of the canister base plate 60 and the circular outer edge of the cover sidewall 72. For embodiments in which the canister 55 and cover 70 are each made from metallic materials, the preferably polymeric, elastomeric, or other non-metallic, composition of thrust bearing 62 prevents metal-on-metal sliding. Doing so correspondingly mitigates the likelihood of squeaking or other sounds emanating from the lift mechanism, ensuring substantially silent operation of the device 5. If the thrust bearing 62 wears due to the frictional and rotating engagement with cover 70, or for other reasons, the user can merely replace it as desired.

Referring now to FIGS. 1-3, 6, and 7, bow arm assembly 100 is attached to the lift mechanism 50, extending away from it and thus also away from the base member 10A. In typical implementations it is adapted and configured to hold, e.g., an archery bow, optionally other hunting accessories as desired. The bow arm assembly 100 extends a distance required to suspend the various accessories within easily accessible grasping range or zone of the user. The bow arm assembly 100 is attached to the cover 70 of lift mechanism 50, whereby the bow arm assembly 100 and cover 70 move in unison with each other. The lift mechanisms 50 thus can retract or move the bow arm assembly 100 from an extended position to a retracted position.

In the extended position, the bow arm assembly 100 extends generally horizontally from the base member 10A since the weight or mass of the bow overwhelms the retracting force of lift mechanism 50. This pushes the bow arm assembly 100 downwardly until, e.g., the pin 75 mechanically engages one of the projections 63, for example a perpendicularly extending side 65, preventing its further decent. In the retracted position, the weight or mass of the bow does not act upon the lift mechanism 50. Since the retracting force is greater than the gravitational force applied to the bow arm assembly 100, the bow arm assembly 100 moves or retracts upwardly until, e.g., the pin mechanically engages the blunt face 65 of another one of the projections 63. The bow arm assembly 100 can be resiliently held in this retracted, upright, position by the preloaded spring 80.

Referring now to FIGS. 1-3, the bow arm assembly 100 can have first and second distinct segments 110, 120. The first segment is proximate the base member 10A and attached, at a first end, to the cover 70. The second segment 120 is attached to a second end of first segment 110. Preferably, the first and second segments 110, 120, are joined by a hinge mechanism 130. This enables them to pivot laterally or horizontally with respect to each other, when the axis of pivotation is generally upright. They may pivot in other, non-lateral or non-horizontal, directions as dictated by the orientation of the axis of pivotation. Preferably the hinge mechanism includes a bolt with a thumbscrew-type head, or other suitable hardware, that can temporarily fix the hinge mechanism and thus lock the first and second segments in position.

Still referring to FIGS. 1-3, a hook 140 can be provided at the distal end of the second segment 120 of bow arm assembly 100. Hook 140 is configured to suspend an archery bow therefrom, preferably by its upper limb or adjacent the upper cam. Like the intersection of the first and second segments 110, 120, the hook 140 can attach to the second segment 120 by way of a hinge mechanism 130 that can be temporarily fixed in position, providing the user with numerous bow orientation options. The hook 140 generally has a soft elastomeric tubular sleeve over it to assure quiet bow removal and replacement.

Referring specifically to FIGS. 1, 8, and 9, camera arm assembly 200 is largely analogous to bow arm assembly 100 (FIGS. 1 and 2), having hinge-type mechanisms 230 between first and second segments 210, 220, and other features common to the bow arm 100. However, in typical implementations, the camera arm 200 is of relatively smaller size. This is because it is typically desirable to mount a camera or video camera relatively near the mounting substrate 6, since a user does not need as ready or quick access to the camera, as compared to the bow. Accordingly, the overall length and other dimensions of the camera arm 200 are much less than the length of the bow arm assembly 100.

Still referring to FIGS. 1, 2 and 9, the camera arm assembly 200 of some embodiments may be used without a lift mechanism 50 (FIGS. 1 and 2). Instead, it may be bolted to a screw boss or threaded bore within the base member 10A, or directly upon a shoulder 30 provided on base member 10B. Preferably, the outermost end of second segment 220 includes a lockable ball and socket joint 240, with a threaded lag bolt to connect to the still camera or video camera, providing a wide range of articulation to facilitate positioning, aiming, and focusing, the camera or video camera. For example, socket joint 240 can allow 360 degrees of rotation about an upright central axis and 45 degrees of upward and downward pivoting adjustability.

Referring still to FIGS. 1, 2, and 9, each of the first and second segments 110, 120 of bow arm assembly 100, and first and second segments 210, 220, of camera arm assembly 200 are preferably made of a lightweight, durable, corrosion resistant material such as aluminum, any of various cast-alloys of aluminum, or other suitable materials. Furthermore, each can have multiple apertures or holes formed thereinto, creating void spaces along their respective lengths. The void spaces lighten the overall weight of the retracting and camera arm assemblies 100, 200, make them visually less conspicuous, and make them easier to see through, as compared to structures having continuously solid surfaces along their lengths.

Referring now to FIG. 3, in some other implementations, the hunting accessory holding devices 5 do not utilize the strap 21 implementing base member 10A or 10B, but rather utilize a different, simpler base member 10C. Base member 10C is generally T-shaped and can function as a support structure for other components of hunting accessory holding devices 5, and as desired, can also be used on its own as a handle or stop to facilitate, e.g., a hunter's entry into or exit from a tree mounted hunting stand. Regardless, base member 10C includes a threaded shaft 25B, that is adapted and configured to penetrate the mounting substrate 6, and correspondingly provides load bearing support for the hunting accessory holding device 5. Body 12 of base member 10C connects to and extends generally perpendicularly from the threaded member 25B.

Still referring to FIG. 3, similar to projection 29 of base member 10B (FIG. 2), the upper end of body 12 of base member 10C defines an upper surface or shoulder 30 having a post 35 extending upwardly therefrom. The hinge barrel 52 of lift mechanism 50 inserts over the post 35, such that the shoulder 30 supports the lower surface of the hinge barrel 52 or an end of camera arm assembly 200, and thus the entire weight of lift mechanism 50 or camera arm assembly 200. A collar 38 can also insert over the post 35, above the hinge barrel or camera arm end. A nut, thumbnut, or knob 40 is secured to the post 35, preferably above the collar 38. This secures the lift mechanism 50 or camera arm assembly 200 to the base member 10C while permitting it to pivot thereon. As with the versions incorporating base member 10A or 10B of FIG. 1, 2 or 4, when lift mechanism 50 is used with base member 10C, it preferably can pivot through a range of motion of at least about 270 degrees of travel.

When it is desired to not use the lift mechanism 50, the first, second, or both, arm segments 110, 120, can be attached directly to the base member 10A, 10B, or 10C. Such implementations retain the lateral or horizontal pivoting functionality described elsewhere herein. For example, referring to FIG. 6, the second arm segment 120 can attach to the base member 10B or 10C, providing lateral pivoting travel and the functionality of hook 140. Stated another way, as seen in FIGS. 1-3 and 8-9, various portions of the lift mechanism 50, arm assembly 100, and camera arm assembly 200, can attach to any one of the base members 10A, 10B, or 10C, as desired. Hence, the various components of the hunting accessory holding device 5 are preferably interchangeable with each other. This can be accomplished, for example, by providing hinge or other joint components of second arm segment 120 or camera arm assembly 200 or other components that are sized or otherwise configured analogously to hinge barrel 52 of the lift mechanism 50. In this regard, some implementations of hunting accessory holding device 5 can be appreciated as a kit having interchangeable, at least partially modular, components, allowing a user to assemble a desired combination of ones of the base members 10A, 10B, 10C, lift mechanism 50, first and second arm segments 110, 120, first and second camera arm segments 210, 220, or others, based on the particular intended end use.

In light of the above, to use the hunting accessory holding device 5, the user first selects the desire mounting substrate 6, be it a tree or otherwise. If the hunting accessory holding device 5 includes base member 10A or 10B, and if it is in a collapsed or folded down state, the user unwraps the strap 21 from around the device if it is wrapped thereabout, and swings or pivots out the camera arm assembly 200. Then, the user pivots the bow arm assembly 100 which correspondingly rotates the cover 70 over the canister 55 and preloads the spring 80, establishing a retracting force within the lift mechanism 50. In so doing, the ramped portions of projections 63 pass over and axially deflect the pin 75, as they encounter the pin 75. The bow arm assembly 100 is rotated in this manner until the desired amount of cover 70 rotation is achieved, whereby the user stops rotating and the pin is urged against a blunt side 65 of a projection 63, maintaining the tension and preload within the spring 80 and defining the retracting force within the lift mechanism 50.

The user then positions body 12 against the mounting substrate 6 at the desired height. One of the end loops 22 of strap 21 is slipped over the support bracket 20. The strap 21 is swung around the mounting substrate, e.g., a tree trunk, and the other end loop 22 is slipped over the support bracket 20 from the other direction. As desired, one or more hooks 24 (FIG. 1) can slide over the strap 21 for hanging various hunting accessories. The strap 21 is tightened by way of the integrated ratchet or cam-lock mechanism such as tightening device 23. The rate of arm retraction is then evaluated and adjusted, as desired, by tightening and/or loosening bolt 78.

To use a hunting accessory holding device 5 that incorporates base member 10C in lieu of base member 10A or 10B, the threaded member is screwed into the mounting substrate 6 at a desired height. Then, the hinge barrel 52 or camera arm assembly 200 (FIG. 9) is slid or inserted over the post 35. Collar 38 is inserted or slid over the post 35, and the thumbscrew, thumbnut, or knob 40 is tightened to secure the assembly.

Many changes and modifications may be made to the present invention without departing from the spirit thereof. The scope of some of these changes is discussed above. The scope of others will become apparent from the appended claims.

We claim:

1. An accessory holding device, comprising:

a body having a fork that can grip against a substrate and a threaded bore that extends through the body;

a strap that loops around the substrate and that holds the base against the substrate;

a bolt extending through the threaded bore of the body so that rotating the bolt in a first direction threadedly advances the bolt through the threaded bore and pushes the bolt toward the substrate;

an arm assembly extending outwardly from the body;

a hinge connecting a first end of the arm assembly to the base and permitting the arm assembly to laterally pivot with respect to the body; and a camera mount located at a second end of the arm assembly opposite the first end and being configured to support a camera.

2. The accessory holding device of claim 1, the arm assembly further comprising first and second arm segments that are connected to each other and that are moveable with respect to each other, wherein the first arm segment is connected to the hinge and the second arm segment bears the camera mount.

3. An accessory holding device, comprising:

a body having a threaded bore that extends therethrough;

a fork that extends away from the body and that can grip against a substrate;

a strap that is connected to the body and that loops around the substrate so as to provide a squeezing force that holds the body against the substrate;

a bolt extending through the threaded bore of the body so that rotating the bolt in a first direction threadedly advances the bolt through the threaded bore and pushes the bolt toward the substrate; and a mount, supported at least indirectly on the body, for holding an accessory.

4. The accessory holding device of claim 3, wherein the substrate is a tree trunk.

5. An accessory holding device comprising:

an elongate body extending at least generally vertically along a tree trunk;

a fork that extends at least generally horizontally away from the body and that grips the tree trunk;

a strap that is spaced vertically apart from the fork, that is attached to the body, and that loops around the tree trunk so as to provide a squeezing force that holds the body against the tree trunk;

a bolt that is spaced vertically apart from the fork and the strap, that extends through a threaded bore in the base, and that pushes against the tree trunk in opposition to the squeezing force of the strap; and a mount, supported at least indirectly on the body, for holding an accessory.

6. The accessory holding device of claim 1, wherein an end of the bolt that pushes against the substrate includes a flange which resists penetrating into the substrate when the bolt is tightened with respect to the body of the accessory holding device, such that when the bolt is rotated with respect to the body, at least a portion of the body is urged away from the substrate in preference to the bolt penetrating the substrate and correspondingly increases a level of tautness of the strap.

7. The accessory holding device of claim 1, wherein the bolt and a pair of ends of the fork engage the substrate and the remainder of the body is generally spaced from the substrate, such that the body defines three distinct points of contact with the substrate when the strap holds the body against the substrate.

8. The accessory holding device of claim 1, the body further comprising a support bracket extending therefrom and the strap further comprising at least one loop that extends over the support bracket.

9. The accessory holding device of claim 8, wherein the support bracket of the body defines a T-shaped configuration.

10. The accessory holding device of claim 3, wherein an end of the bolt that pushes against the substrate includes a flange which resists penetrating into the substrate when the bolt is tightened with respect to the body of the accessory holding device, such that when the bolt is rotated with respect to the body, at least a portion of the body is urged away from the substrate in preference to the bolt penetrating the substrate.

11. The accessory holding device of claim 3, wherein the bolt and a pair of ends of the fork engage the substrate and the remainder of the body is generally spaced from the substrate, such that the body defines three distinct points of contact with the substrate when the strap holds the body against the substrate.

12. The accessory holding device of claim 3, the body further comprising a support bracket extending therefrom and the strap further comprising at least one loop that extends over the support bracket.

13. The accessory holding device of claim 12, wherein the support bracket of the body defines a T-shaped configuration.

14. The accessory holding device of claim 5, wherein an end of the bolt that pushes against the tree trunk includes a flange which resists penetrating into the tree trunk when the bolt is tightened with respect to the body of the accessory holding device, such that when the bolt is rotated with respect to the body, at least a portion of the body is urged away from the tree trunk in preference to the bolt penetrating the tree trunk.

15. The accessory holding device of claim 5, wherein the bolt and a pair of ends of the fork engage the tree trunk and the remainder of the body is generally spaced from the tree trunk, such that the body defines three distinct points of contact with the tree trunk when the strap holds the body against the tree trunk.

16. The accessory holding device of claim 5, the body further comprising a support bracket extending therefrom and the strap further comprising at least one loop that extends over the support bracket.

17. The accessory holding device of claim 16, wherein the support bracket of the body defines a T-shaped configuration.

18. An accessory holding device comprising:

an elongate body extending at least generally vertically along a tree trunk, the body defining a first end and an opposing second end;

an arm extending from and being pivotally attached to one of the first and second ends of the body so that the arm pivots through a range of motion of at least about 270 degrees of movement with respect to the body; and a camera mount connected to an end of the arm which is furthest from the body, the camera mount including a lag bolt that connects to a camera and a ball and socket joint that allows articulation of the camera mount with respect to the remainder of the accessory holding device.

19. The accessory holding device of claim 18, wherein the body defines a generally T-shaped perimeter and further comprises at least one of (i) a nut, (ii) a thumbnut, and (iii) a knob that secures the arm to the body.

20. The accessory holding device of claim 19, wherein the ball and socket joint of the camera mount is lockable in a fixed position and allows 360 degrees of rotation of the camera mount about an upright central axis thereof.

* * * * *

UNITED STATES PATENT AND TRADEMARK OFFICE

CERTIFICATE OF CORRECTION

PATENT NO. : 7,861,987 B2
APPLICATION NO. : 12/183297
DATED : January 4, 2011
INVENTOR(S) : Gorsuck et al.

It is certified that error appears in the above-identified patent and that said Letters Patent is hereby corrected as shown below:

Title page, item (75) inventors: Delete "Horsuck" and replace with -- Gorsuck --.

Signed and Sealed this
Twenty-second Day of February, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,861,987 B2
APPLICATION NO. : 12/183297
DATED : January 4, 2011
INVENTOR(S) : Gorsuch et al.

It is certified that error appears in the above-identified patent and that said Letters Patent is hereby corrected as shown below:

Title page, item (75) inventors; should read -- Timothy M. Gorsuch, Mukwonago, WI (US); James A Buckley, Mukwonago, WI (US) --

Title page, item (73) "Timothy M. Horsuch" should read -- Timothy M. Gorsuch --.

This certificate supersedes the Certificate of Correction issued February 22, 2011.

Signed and Sealed this
Twelfth Day of April, 2011

David J. Kappos

David J. Kappos
*Director of the United States Patent and Trademark Office*